US008006773B2

(12) United States Patent
Courville et al.

(10) Patent No.: US 8,006,773 B2
(45) Date of Patent: Aug. 30, 2011

(54) SWELLABLE PACKER CONSTRUCTION FOR CONTINUOUS OR SEGMENTED TUBING

(75) Inventors: Perry W. Courville, Houston, TX (US); Mark Kalman, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/615,335

(22) Filed: Nov. 10, 2009

(65) Prior Publication Data

US 2010/0051295 A1 Mar. 4, 2010

Related U.S. Application Data

(62) Division of application No. 11/875,779, filed on Oct. 19, 2007, now Pat. No. 7,762,344.

(30) Foreign Application Priority Data

Oct. 20, 2006 (WO) ..... PCT/US2006/060094

(51) Int. Cl.
*E21B 19/22* (2006.01)
*E21B 33/12* (2006.01)

(52) U.S. Cl. ..... 166/387; 166/179; 166/77.2

(58) Field of Classification Search ..... 166/77.2, 166/387, 179
See application file for complete search history.

(56) References Cited

U.S. PATENT DOCUMENTS

| | | | |
|---|---|---|---|
| 2,275,936 | A | 3/1942 | Baker |
| 2,830,540 | A | 4/1958 | Vincent |
| 2,942,666 | A | 6/1960 | Boer et al. |
| 3,385,367 | A | 5/1968 | Kollsman |
| 4,234,197 | A | 11/1980 | Amancharla |
| 4,375,240 | A | 3/1983 | Baugh et al. |
| 4,971,152 | A | 11/1990 | Koster et al. |
| 5,413,170 | A | 5/1995 | Moore |
| 5,423,383 | A | 6/1995 | Pringle |
| 5,425,420 | A | 6/1995 | Pringle |
| 5,433,269 | A | 7/1995 | Hendrickson |

(Continued)

FOREIGN PATENT DOCUMENTS

WO 2004015238 A1 2/2004

(Continued)

OTHER PUBLICATIONS

Office Action issued Jun. 16, 2010, for U.S. Appl. No. 12/016,600, 47 pages.

(Continued)

*Primary Examiner* — Kenneth Thompson
(74) *Attorney, Agent, or Firm* — Marlin R. Smith

(57) ABSTRACT

A swellable packer construction for continuous or segmented tubing. A method of constructing a swellable packer on a continuous tubular string includes the steps of: attaching a swellable seal material to the tubular string to thereby form the packer; and then wrapping the tubular string with the packer on a spool. A swellable packer includes a tubular body portion for incorporation into a tubular string, and a seal material wrapped about the body portion, the seal material being swellable in response to contact with a fluid. A method of constructing a swellable packer for a tubular string includes the steps of: wrapping a seal material about a tubular body portion to thereby form the packer; and then swelling the seal material in response to contact with a fluid. A continuous tubular string includes a seal material attached to a body portion of the tubular string to thereby form a swellable packer; and the packer wrapped with the tubular string on a spool.

33 Claims, 4 Drawing Sheets

U.S. PATENT DOCUMENTS

| | | | | |
|---|---|---|---|---|
| 5,465,793 | A | 11/1995 | Pringle | |
| 5,488,992 | A | 2/1996 | Pringle | |
| 6,009,951 | A | 1/2000 | Coronado et al. | |
| 6,318,729 | B1 | 11/2001 | Pitts, Jr. et al. | |
| 6,351,985 | B1 | 3/2002 | Bedwell | |
| 6,494,496 | B1 * | 12/2002 | Sweeney | 285/115 |
| 6,581,682 | B1 | 6/2003 | Parent et al. | |
| 6,705,615 | B2 | 3/2004 | Milberger et al. | |
| 7,059,415 | B2 | 6/2006 | Bosma et al. | |
| 7,070,001 | B2 | 7/2006 | Whanger et al. | |
| 7,121,352 | B2 | 10/2006 | Cook et al. | |
| 7,124,831 | B2 | 10/2006 | Turley et al. | |
| 7,152,684 | B2 | 12/2006 | Harrall et al. | |
| 7,195,730 | B2 | 3/2007 | Calderoni et al. | |
| 7,228,915 | B2 | 6/2007 | Thomson | |
| 7,422,071 | B2 | 9/2008 | Wilkie et al. | |
| 2004/0020662 | A1 | 2/2004 | Freyer | |
| 2005/0199401 | A1 | 9/2005 | Patel et al. | |
| 2006/0272806 | A1 | 12/2006 | Wilkie et al. | |
| 2007/0012436 | A1 | 1/2007 | Freyer | |
| 2007/0131414 | A1 | 6/2007 | Calderoni | |
| 2007/0221387 | A1 | 9/2007 | Levy | |
| 2008/0078561 | A1 | 4/2008 | Chalker et al. | |
| 2008/0093086 | A1 | 4/2008 | Courville et al. | |
| 2008/0185158 | A1 | 8/2008 | Chalker et al. | |
| 2008/0308283 | A1 | 12/2008 | Freyer | |
| 2009/0211770 | A1 | 8/2009 | Nutley et al. | |

FOREIGN PATENT DOCUMENTS

| | | | |
|---|---|---|---|
| WO | 2005116394 | A1 | 12/2005 |
| WO | 2006118470 | A1 | 11/2006 |
| WO | 2008033115 | A1 | 3/2008 |

OTHER PUBLICATIONS

International Search Report and Written Opinion issued Aug. 17, 2010, for International Patent Application Serial No. PCT/US06/60094, 12 pages.

Protech Centerform Integral Bow Spring Centralizer webpage, 2006, 3 pages.

Protech Centerform Case Histories, 2006, 3 pages.

Protech Centerform Carbon Fiber Composite Centralizers, 2006, 2 pages.

International Search Report and Written Opinion issued Jun. 27, 2008, for International Patent Application Serial No. PCT/US08/50371, 7 pages.

Salamy, S.P., Al-Mubarak, H.K., Hembling, D.E., and Al-Ghamdi, M.S., Deployed Smart Technologies Enablers for Improving Well Performance in Tight Reservoirs, SPE 99281, Apr. 11-13, 2006, 6 pages, Amsterdam.

Jennings, Iain, Enhancing Production Using Solid Expandable Tubulars in Workover Campaigns, SPE 107624, Apr. 16-18, 2007, 5 pages, Denver, Colorado.

Kleverlaan, M., Van Noort, R. H., Jones, I., Deployment of Swelling Elastomer Packers in Shell E&P, SPE 92346, Feb. 23-25, 2005, 5 pages, Amsterdam.

Halliburton Swellpacker® Cable System Product Brochure, 2008, 2 pages.

Office Action issued Jun. 22, 2009, for U.S. Appl. No. 11/852,295, 16 pages.

Office Action issued Dec. 3, 2009, for U.S. Appl. No. 11/852,295, 10 pages.

International Preliminary Report on Patentability issued Mar. 26, 2009, for International Patent Application Serial No. PCT/US06/35052, 5 pages.

International Preliminary Report on Patentability with Written Opinion issued Aug. 20, 2009, for International Patent Application Serial No. PCT/US07/61703, 7 pages.

International Search Report and Written Opinion issued Mar. 21, 2008, for International Patent Application Serial No. PCT/US07/61703, 7 pages.

Final Office Action issued Nov. 5, 2010, for U.S. Appl. No. 12/016,600, 10 pages.

Office Action issued Mar. 16, 2011, for U.S. Appl. No. 12/016,660, 8 pages.

* cited by examiner

SWELLABLE PACKER CONSTRUCTION FOR CONTINUOUS OR SEGMENTED TUBING

CROSS-REFERENCE TO RELATED APPLICATION APPLICATIONS

This application is a division of prior U.S. application Ser. No. 11/875,779 filed on Oct. 19, 2007, and also claims the benefit under 35 USC §§119 and 365 of the filing date of International Application No. PCT/US2006/060094, filed Oct. 20, 2006. The entire disclosures of these prior applications are incorporated herein by this reference.

BACKGROUND

The present invention relates generally to equipment utilized and operations performed in conjunction with a subterranean well and, in an embodiment described herein, more particularly provides a swellable packer construction for continuous or segmented tubing.

Packers and other well tools are typically constructed separate from the remainder of the tubular strings in which they are to be incorporated. In many circumstances, this is a desirable way of constructing well tools, since a position of the well tool in the tubular string may not be known beforehand, and the well tool may be used in different tubular strings.

However, there are other circumstances in which there are disadvantages associated with constructing well tools separate from the remainder of the tubular strings in which they are to be incorporated. For example, if the position of a well tool in a continuous tubular string is known before the tubular string is to be transported to a wellsite, then the well tool could be incorporated into the tubular string at that time, rather than spending time with this operation at the wellsite. As another example, if the position of, or need for, a well tool in a continuous, jointed or segmented tubular string is not known beforehand, then it would be advantageous to be able to construct the well tool at the wellsite, even if a portion of the tubular string has already been installed in a wellbore.

Swellable packers are known in the art. However, prior swellable packers have typically been constructed separate from the tubular strings in which they are to be incorporated.

Therefore, it may be seen that improvements are needed in the art of constructing well tools. In particular, such improvements are needed in the art of constructing swellable packers for continuous or segmented tubular strings.

SUMMARY

In carrying out the principles of the present invention, a swellable packer construction is provided which solves at least one problem in the art. One example is described below in which a swellable packer is constructed on a continuous tubing, and then the packer is wrapped on a spool with the tubing string. Another example is described below in which a swellable seal material is helically wrapped onto a continuous or segmented tubular string. Another example is described below in which a swellable seal material is formed as a cylinder, is split longitudinally, then placed on a continuous or segmented tubular string.

In one aspect of the invention, a method of constructing a swellable packer on a continuous tubular string is provided. The method includes the steps of: attaching a swellable seal material to the tubular string to thereby form the packer; and then wrapping the tubular string with the packer on a spool. The seal material is swellable in response to contact with a fluid.

In another aspect of the invention, a swellable packer is provided which includes a generally tubular body portion configured for incorporation in a tubular string. A swellable seal material is wrapped helically about the body portion. The seal material is swellable in response to contact with a fluid.

In yet another aspect of the invention, a method of constructing a swellable packer for a tubular string includes the steps of: forming a swellable seal material in a cylindrical shape about a mandrel; removing the swellable seal material from the mandrel by splitting it helically; then wrapping a swellable seal material helically about a generally tubular body portion to thereby form the packer; and then swelling the seal material in response to contact with a fluid.

In yet another aspect of the invention, a method of constructing a swellable packer for a tubular string includes the steps of: forming a swellable packer in a cylindrical shape about a mandrel; removing the swellable packer from the mandrel by splitting it longitudinally; then placing it on a continuous or segmented tubular string; and then swelling the seal material in response to contact with a fluid.

In a further aspect of the invention, a continuous tubular string is provided which includes a swellable seal material attached to an integral body portion of the tubular string to thereby form a swellable packer. The swellable packer is wrapped with the tubular string on a spool.

In a still further aspect of the invention, a method of constructing a swellable packer on a tubular string is provided which includes the steps of: inserting the tubular string into a wellbore; and attaching a swellable seal material to the tubular string to thereby form the packer. The attaching step is performed during the inserting step.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
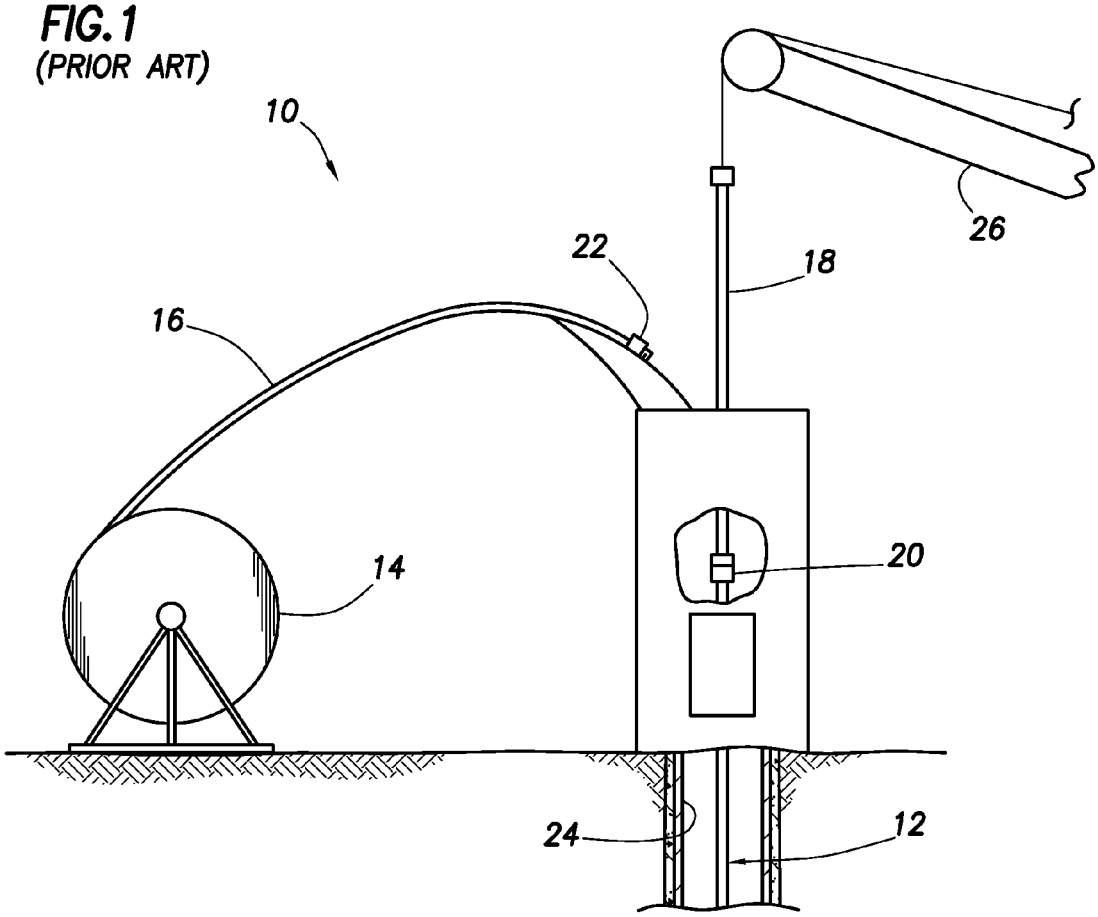
FIG.1 (PRIOR ART)
FIG. 1 is a schematic view of a prior art method of interconnecting well tools in tubular strings.

Representatively illustrated in FIG. 1 is a prior art method 10 of interconnecting a well tool 18 in a tubular string 12. As depicted in the drawing, a lower portion of the tubular string 12 has already been installed in a wellbore 24. A connection 20, typically provided with threads and seals, is used to connect the well tool 18 to the lower portion of the tubular string 12.

When the well tool 18 has been connected at its lower end, the well tool and the lower portion of the tubular string 12 are lowered further into the wellbore 24. These connecting and lowering operations are facilitated by a wellsite crane, workover rig or drilling rig (including drawworks, pipe tongs, floor slips, rotary table, etc.), coiled tubing injector head, or any other type of connecting and lowering means 26.

After sufficiently lowering the well tool 18, another connector 22 is connected at an upper end of the well tool 18. In the depicted method 10, the connector 22 is provided on a continuous tubing 16 of the type known to those skilled in the art as "coiled" tubing.

However, note that other types of tubular strings may be used, including segmented tubular strings (such as production tubing, drill pipe, etc.). The lower portion of the tubular string 12 may also be continuous or segmented.

For example, the lower portion of the tubular string 12 may be part of the continuous tubing 16 which is initially installed in the wellbore 24. The tubing 16 is then cut, the connectors 20, 22 are installed on either side of the cut, the well tool 18 is connected between the connectors, and then the tubular string 12 is further installed in the wellbore.

It will be readily appreciated that this prior art method 10 is inconvenient, time-consuming and relatively expensive to perform. Additional expense is incurred at least due to the wellsite equipment needed to cut the tubing 16, install the connectors 20, 22, connect the well tool 18 in the tubular string 12, etc.

If continuous tubing is to be used, it would be much more convenient, economical, etc. to be able to interconnect the well tool 18 in the tubing 16 prior to delivering the tubular string to the wellsite. This would eliminate the time and equipment needed to cut the tubing 16, install the connectors 20, 22, etc. at the wellsite. In addition, the separate connecting and lowering means 26 may not be needed, for example, if a conventional coiled tubing injector head could be used instead.

If segmented tubing is to be used, then certain advantages may also be obtained by using the principles of the invention, some embodiments of which are described below. For example, the well tool 18 could be constructed or completed after it has been connected to the lower portion of the tubular string 12 or has otherwise become contiguous with the tubular string.

For both continuous and segmented tubing, it would be advantageous to be able to install a packer externally to the tubing at any location along the tubular string 12, without the need for connectors 20 and 22, as it is being lowered into the wellbore 24.

Figure 2:
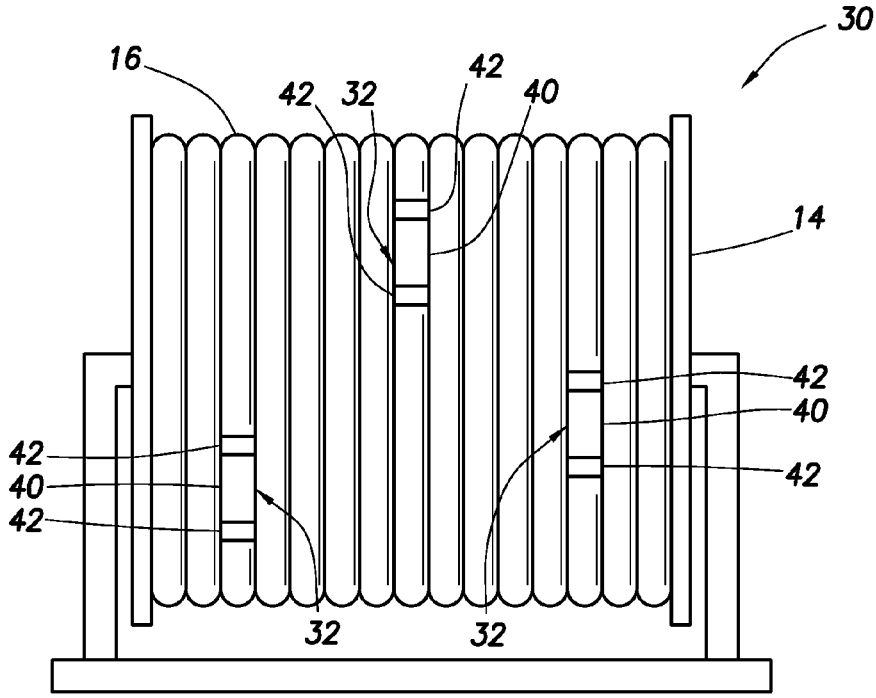
FIG. 2 is a schematic view of a method of interconnecting swellable packers in a continuous tubing string, the method embodying principles of the invention.

Referring additionally now to FIG. 2, a continuous tubular string 30 embodying principles of the present invention is representatively illustrated. The tubular string 30 includes the continuous tubing 16 wrapped on the spool 14, as in the method 10 described above.

However, the tubular string 30 of FIG. 2 also includes one or more swellable packers 32 as part of the tubular string. The swellable packers 32 are preferably incorporated into the tubular string 30 at predetermined positions and spacings, according to the specifications for a particular well, the swellable packers are wrapped with the remainder of the tubular string on the spool 14, and then the tubular string is transported to the wellsite for installation.

Figure 3:
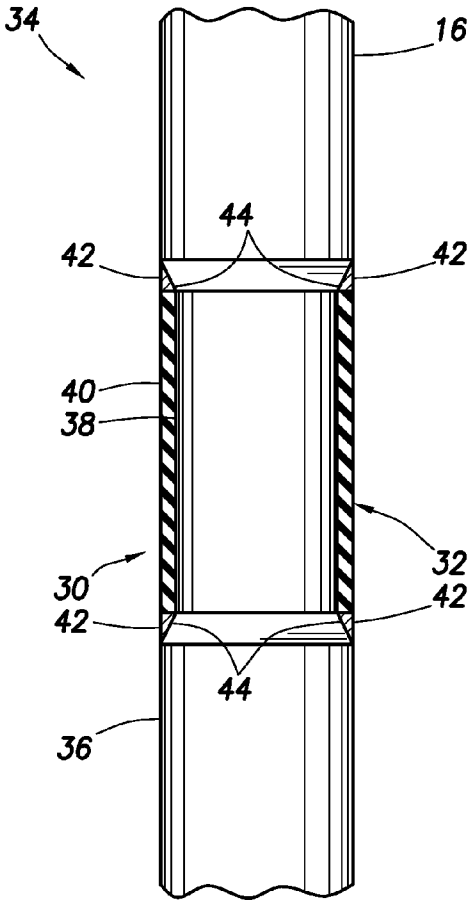
FIG. 3 is a schematic partially cross-sectional view of a swellable packer construction embodying principles of the invention.

One example of a method 34 for constructing the swellable packers 32 is representatively illustrated in FIG. 3. This drawing depicts an enlarged view of a tubular body portion 36 of one packer 32.

The body portion 36 is preferably an integrally formed portion of the overall continuous tubing 16. However, the body portion 36 could be separately formed from the remainder of the tubing, if desired.

An annular recess 38 is formed on an outer surface of the body portion 36. If the body portion 36 is an integral portion of the tubing 16, then the recess 38 could be formed by, for example, a swaging operation.

If the body portion 36 is separately formed from the remainder of the tubing 16, then the recess 38 could be formed by, for example, a machining operation. The recess 38 may be formed in any manner in keeping with the principles of the invention.

A swellable seal material 40 is positioned in the recess 38. Preferably, the seal material 40 does not extend radially outward beyond the outer surface of the tubing 16, so that the packer 32 can be conveniently wrapped with the tubing on the spool 14. However, the seal material 40 could extend radially outward beyond the outer surface of the tubing 16, if desired.

The swellable seal material 40 swells when contacted by an appropriate fluid. The term "swell" and similar terms (such as "swellable") are used herein to indicate an increase in volume of a seal material. Typically, this increase in volume is due to incorporation of molecular components of the fluid into the seal material itself, but other swelling mechanisms or techniques may be used, if desired.

When the seal material swells, it expands radially outward into contact with a well surface, such as the inner surface of a casing, liner or tubing string, or the inner surface of a wellbore. Note that swelling is not the same as expanding, although a seal material may expand as a result of swelling.

For example, in conventional packers, a seal element may be expanded radially outward by longitudinally compressing the seal element, or by inflating the seal element. In each of these cases, the seal element is expanded without any increase in volume of the seal material of which the seal element is made.

Various techniques may be used for contacting the swellable seal material with appropriate fluid for causing swelling of the seal material. The fluid may already be present in the well when the packer 32 is installed in the well, in which case the seal material of the packer preferably includes features (such as absorption delaying coatings or membranes, swelling delayed material compositions, etc.) for delaying the swelling of the seal material. Thus, the seal material 40 may be part of an overall seal assembly which includes any combination of coatings, membranes, reinforcements, etc.

The fluid which causes swelling of the seal material 40 may be circulated through the well to the packer 32 after the packer is in the well. As another alternative, the well fluid which causes swelling of the seal material 40 may be produced into the wellbore from a formation surrounding the wellbore. Thus, it will be appreciated that any method may be used for causing swelling of the seal material of the packer 32 in keeping with the principles of the invention.

The fluid which causes swelling of the seal material 40 could be water and/or hydrocarbon fluid (such as oil or gas). For example, water or hydrocarbon fluid produced from a formation surrounding the wellbore could cause the seal material 40 to swell.

Various seal materials are known to those skilled in the art, which seal materials swell when contacted with water and/or hydrocarbon fluid, so a comprehensive list of these materials will not be presented here. Partial lists of swellable seal materials may be found in U.S. Pat. Nos. 3,385,367 and 7,059,415, and in U.S. Published Application No. 2004-0020662, the entire disclosures of which are incorporated herein by this reference. However, it should be understood that any seal material which swells when contacted by any type of fluid may be used in keeping with the principles of the invention.

The seal may also be formed from a material with a considerable portion of cavities which are compressed or collapsed at the surface condition. Then, when being placed in the well at a higher pressure, the material is expanded by the cavities filling with fluid. This type of apparatus and method might be used where it is desired to expand the packer in the presence of gas rather than oil or water. A suitable seal material and method are described in International Application No. PCT/NO2005/000170 (published as WO 2005/116394), the entire disclosure of which is incorporated herein by this reference.

Also positioned in the recess 38 are optional members 42, which in this embodiment are wedge-shaped in the cross-sectional view of FIG. 3. The members 42 may perform any of several functions in the packer 32. For example, the members 42 may serve to prevent or block extrusion of the seal material 40, and/or to grip the well surface to anchor the tubing 16 in the well, etc.

The members 42 are displaced radially outward when the seal material 40 swells. The swelling seal material 40 biases the members 42 longitudinally outward, so that they displace along inclined surfaces 44 at either end of the recess 38, thereby also displacing the members radially outward.

Figure 4:
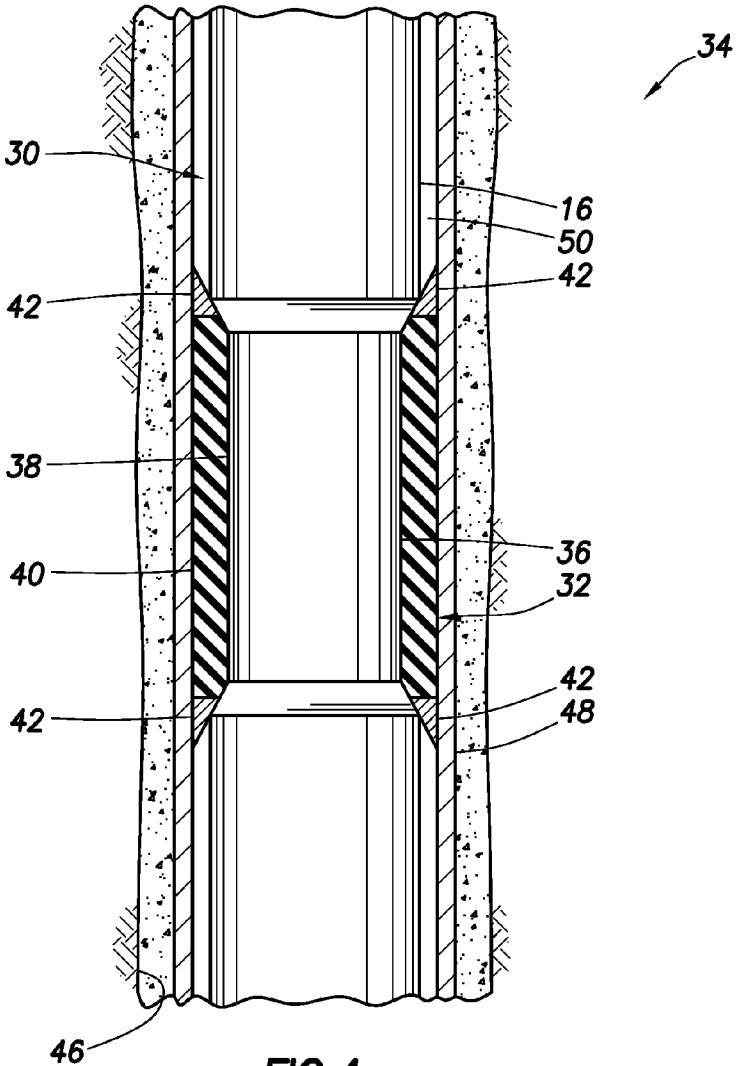
FIG. 4 is a schematic partially cross-sectional view of the swellable packer construction of FIG. 3 installed in a well.

The packer 32 is representatively illustrated in FIG. 4 after the seal material 40 has swollen or expanded in response to contact with fluid. The tubular string 30 is installed in a wellbore 46 in which another tubular string 48 (such as casing, liner, pipe or tubing) has previously been installed.

The seal material 40 now sealingly engages an interior surface of the tubular string 48. Note that the members 42 have been radially outwardly displaced by the swollen or expanded seal material 40.

The members 42 can block extrusion of the seal material 40 due to a pressure differential in an annulus 50 formed between the tubular strings 30, 48 and/or the members can serve to anchor the tubular string 30 against displacement relative to the tubular string 48. If the members 42 are used as anchoring members, then they may be provided with teeth, serrations or other gripping devices on their outer surfaces.

It is not necessary for the packer 32 to seal within a tubular string in a well. For example, the packer 32 could be positioned in an uncased portion of the wellbore 46, and the packer could sealingly engage an inner surface of the wellbore itself.

Figure 5:
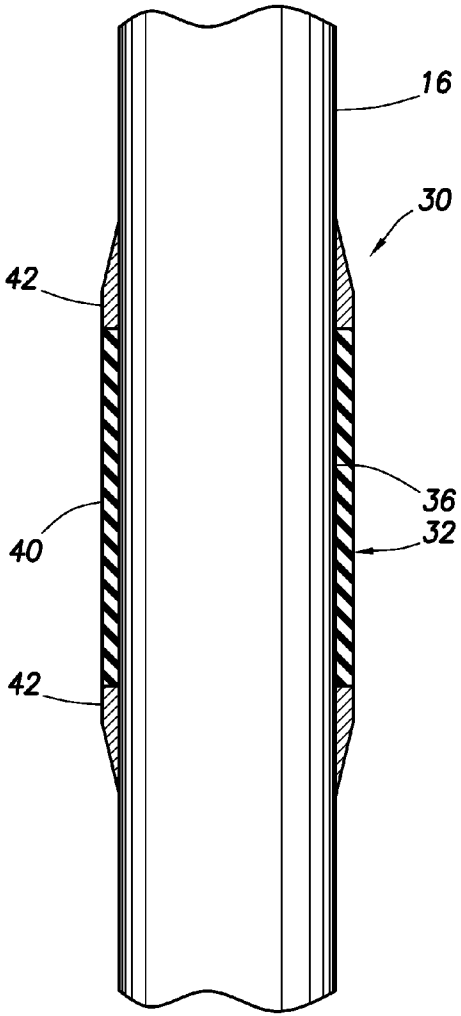
FIG. 5 is a schematic partially cross-sectional view of an alternate swellable packer construction embodying principles of the invention.

Referring additionally now to FIG. 5, an alternate embodiment of the packer 32 is representatively illustrated. In this construction of the packer 32, the seal material 40 is not positioned in a recess 38 on the body portion 36. Instead, the seal material 40 is positioned on the body portion 36 which has the same, or approximately the same, outer diameter as the tubing string 16.

Preferably, the members 42 are attached to the outer surface of the body portion 36 and serve to secure and protect the seal material 40 therebetween, as well as serving to block extrusion of the seal material downhole. The members 42 could be displaced in response to swelling of the seal material 40, in a manner similar to that described above for the embodiment of FIGS. 2 & 3, if desired.

In a preferred method of constructing the packer 32 in the embodiments of FIGS. 2-5, the seal material 40 is preferably applied to the body portion 36, and then the seal material is cured. Swellable seal material curing techniques are well known to those skilled in the art, and so these techniques will not be described further herein.

By applying the seal material 40 to the body portion 36 prior to curing the seal material, a continuous and seamless form of the seal material is produced. This method also has advantages when the body portion 36 is an integral portion of the continuous tubing 16, and the seal material 40 cannot be conveniently slipped over one end of the tubing and properly positioned on the tubing. This method has further advantages when the seal material 40 is to be positioned in the integral recess 38 on the body portion 36, because the seal material does not have to be stretched over any larger diameter sections of the body portion or tubing 16.

It should be clearly understood, however, that it is not necessary for the seal material 40 to be cured after having been applied to the body portion 36. The seal material 40 could instead be wrapped about the body portion 36 after having been cured. An example of such a method is described more fully below.

Figure 6:
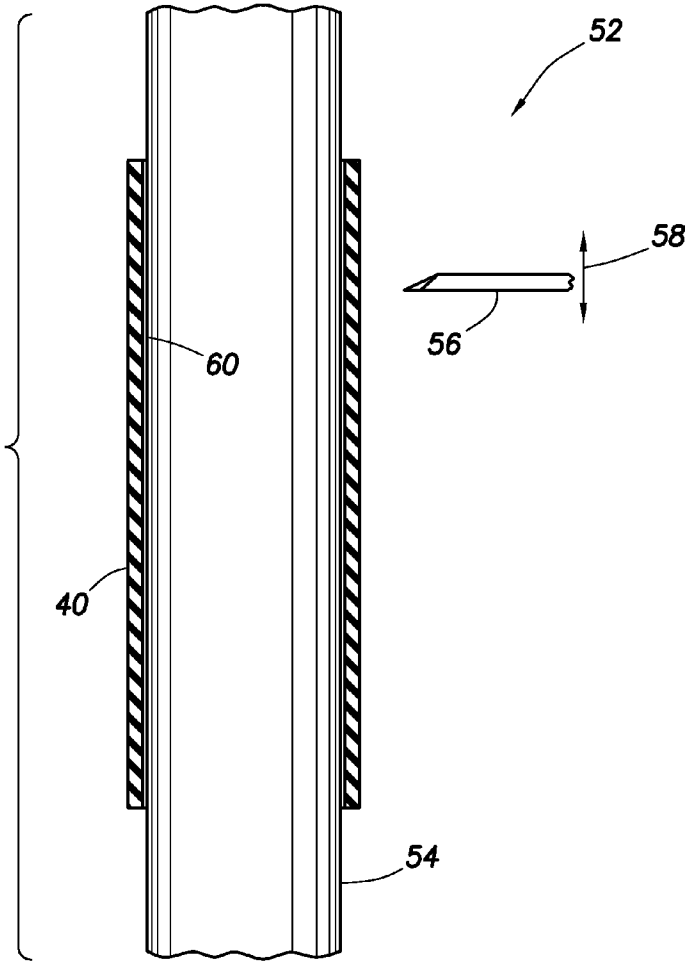
FIG. 6 is a schematic partially cross-sectional view of a method of forming a swellable packer seal material.

Referring additionally now to FIG. 6, another method 52 of constructing an alternate embodiment of the swellable packer 32 is representatively illustrated. In this method 52, the seal material 40 is applied to a generally cylindrical mandrel 54, and is then cured.

A cutting tool 56 (such as a knife, other type of blade or lathe tool, etc.) is then used to cut the seal material 40 off of the mandrel 54. For example, a longitudinal slit may be made through the seal material 40, or the mandrel 54 may be rotated while the cutting tool 56 is displaced longitudinally along the mandrel (in the direction indicated by the arrow 58 in FIG. 6), to thereby helically cut the seal material. If helically cut, a pitch of approximately 15-30 cm may be used, with the pitch depending on several factors, such as the diameter of the body portion 36 on which the seal material 40 will eventually be installed.

Other techniques for removing the seal material 40 from the mandrel 54 after curing may be used in keeping with the principles of the invention. A release agent, lubricant, membrane, film, or other type of release material 60 may be used between the seal material 40 and the mandrel 54 to facilitate removal of the seal material from the mandrel.

Figure 7:
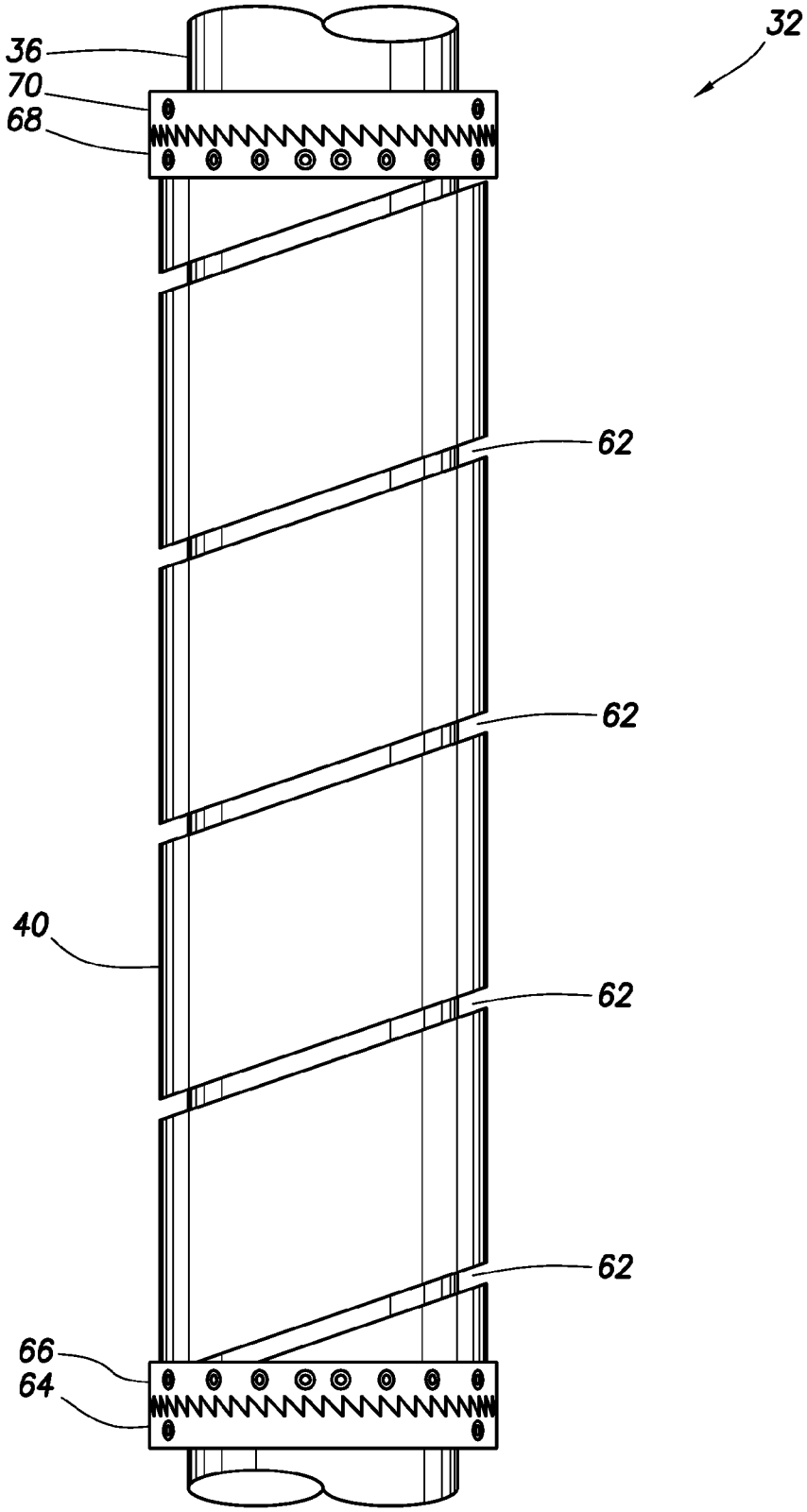
FIG. 7 is a schematic view of a method of constructing a swellable packer using the seal material of FIG. 6.

Referring additionally now to FIG. 7, the seal material 40 is depicted after having been helically cut off of the mandrel 54, and then helically wrapped about the body portion 36. In this manner, this alternate construction of the packer 32 can be installed on the continuous tubing 16 or on a segmented tubular string, either prior to or after arriving at the wellsite, or even as the tubular string is being lowered into the wellbore.

As depicted in FIG. 7, the seal material 40 is wrapped about the body portion 36 with either no gaps or small gaps 62 between adjacent wraps of the seal material. The gaps 62 may remain after the packer 32 is constructed, in which case the seal material 40 will preferably close and seal off the gaps when it swells downhole.

The gaps 62 may result from the mandrel 54 diameter being different than the continuous tubing 16 or segmented tubing diameter, or it may result from the cutting process removing some material from the seal material 40, or due to the seal material 40 being applied over a length on the continuous tubing 60 or segmented tubing which is different than the length of the seal material 40 on the mandrel 54. The gap 62 should be sufficiently small so that when the seal material 40 swells or expands due to contact with the fluid in the wellbore, is closes with sufficient compression between adjacent wraps to prevent flow of fluid along the length of the packer 32.

The gaps 62 may be reduced or eliminated when the packer 32 is constructed by tightening the seal material 40 about the body portion 36, while reducing the length over which the seal material 40 is installed. This tightening operation may include circumferentially stretching the seal material 40 about the body portion 36 while moving a loose end axially closer to a fixed end of the seal material 40. One method of doing this is described below.

A segmented ring 64 is secured to the body portion 36, for example, by clamping, welding, fastening, etc. Another segmented ring 66 is attached at a lower end of the seal material 40, for example, by bolting and/or adhesive bonding. The segmented rings 64, 66 are split into two or more circumferential segments so that they can be applied to the continuous body portion 36 without cutting the body portion or installing the seal material 40 over one end of the body portion. The rings 64, 66 are engaged with each other (for example, using serrations or another type of locking engagement), so that the ring 66 and the lower end of the seal material 40 is prevented from rotating about the body portion 36.

After wrapping the seal material 40 about the body portion 36 and securing the segmented ring 64 to the body portion, the seal material is tightened about the body portion by applying torque to another ring 68 attached at an upper end of the seal material. While tightening, the ring 68 is moved axially toward rings 64, 66. This reduces or completely eliminates the gaps 62 and may apply circumferential tension to the seal material 40.

After the tightening operation, the ring 68 may be secured in position by engagement with another ring 70 attached to the body portion 36. Again, this engagement may be by means of serrations formed on the rings 68, 70 or any other type of locking engagement. The serrations or other locking means may allow one-way rotation of the rings 66, 68 (or either of them) relative to the other rings 64, 70, so that the seal material 40 can be tightened around the body portion 36 from either or both ends thereof.

In another embodiment, rings 64, 66 are combined into one segmented ring, and rings 68, 70 are combined into another segmented ring, where each combined segmented ring is attached by bolting and/or adhesive bonding to the seal material 40. The combined segmented rings would be both securable to the body portion 36 during installation at the wellsite and allow for axial and circumferential adjustment to tighten the seal material 40 onto the body portion 36 and eliminate or minimize the gaps 62.

A material may be applied between the body portion 36 and the seal material 40 before the seal material is tightened about the body portion. For example, this material may serve as a lubricant to facilitate uniform sliding displacement of the seal material 40 about the body portion 36 during the tightening process, and then the material may serve as an adhesive and/or sealant to bond the seal material to the body portion after the tightening process and to prevent fluid leakage between the seal material and the body portion.

If the seal material 40 is removed from the mandrel by cutting a longitudinal slit, then the cylindrically shaped seal material would be spread open at the slit and placed on the body portion 36. Adhesive applied between the seal material 40 and body portion 36 and/or rings 42, or rings 64, 66 or rings 68, 70, or combinations thereof, may be used to prevent longitudinal movement of the seal material along the body portion.

As described above, the body portion 36 in the embodiments of the packer 32 depicted in FIGS. 2-7 may be incorporated into continuous or segmented tubular strings. If a continuous tubular string (such as the tubular string 30) is used, then the body portion 36 may be an integrally formed portion of a continuous tubing (such as the tubing 16) from which the tubular string is constructed. In this case, the seal material 40 may be installed on the body portion 36 before or after the tubular string is transported to the wellsite.

If a segmented tubular string is used, then the body portion 36 may be included in one of the tubular string segments. In this case, the seal material 40 may be installed on the body portion 36 before or after the body portion is contiguous or attached to the tubular string. For example, the body portion 36 could be connected to a lower portion of the tubular string previously installed in the well, and then the seal material 40 could be installed on the body portion prior to lowering the body portion into the well.

Such a continuous or segmented tubular string may be used in a workover, completion, retrofit, stimulation, drilling or any other type of operation. The continuous or segmented tubular string may be used in an open hole, cased hole or any other type of wellbore environment.

An adhesive, sealant or any other type of material may be used between the seal material 40 and the body portion 36 in any of the embodiments described above, if desired.

As used herein, the term "packer" is used to indicate an annular barrier, for example, for sealing an annulus formed in a well. Thus, a plug (such as a bridge plug, etc.), a hanger (such as a liner or tubing hanger, etc.) and other types of well tools may incorporate a packer therein. The body portion 36 of the packer 32 described above could be non-tubular, solid or otherwise prevent fluid communication therethrough if the packer is incorporated into a plug.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A swellable packer, comprising:

a generally tubular body portion configured for incorporation in a tubular string; and a swellable seal material which seals an annular space in response to swelling of the swellable seal material due to contact with a fluid and which is at least one of: a) wrapped helically about the body portion, and b) split longitudinally and placed about the body portion.

2. The swellable packer of claim 1, wherein the tubular string is a continuous tubular string, and wherein the body portion is an integrally formed portion of the continuous tubular string.

3. The swellable packer of claim 1, wherein the tubular string is a segmented tubular string.

4. The swellable packer of claim 1, wherein the seal material is stretched circumferentially about the body portion.

5. The swellable packer of claim 4, wherein the circumferential stretching of the seal material functions to at least one of: a) reduce gaps between adjacent helical wraps of the seal material, and b) close a gap in a longitudinal slit in the seal material.

6. The swellable packer of claim 1, wherein the seal material is positioned in a recess formed on an outer surface of the body portion.

7. The swellable packer of claim 1, further comprising an extrusion blocking member positioned for radially outward displacement in response to swelling of the seal material.

8. The swellable packer of claim 1, further comprising an anchoring member positioned for radially outward displacement in response to swelling of the seal material.

9. A continuous tubular string, comprising:

a swellable seal material attached to an integral body portion of the tubular string thereby forming a swellable packer, wherein the swellable seal material seals an annular space in response to swelling of the swellable seal material due to contact with a fluid; and the swellable packer wrapped with the tubular string on a spool.

10. The tubular string of claim 9, wherein the swellable seal material is attached to the body portion prior to curing the swellable seal material.

11. The tubular string of claim 9, wherein the swellable seal material is wrapped about the tubular string.

12. The tubular string of claim 9, wherein the swellable seal material is wrapped helically about the tubular string.

13. The tubular string of claim 9, wherein the swellable seal material is circumferentially stretched about the tubular string.

14. The tubular string of claim 13, wherein the circumferential stretching of the seal material reduces gaps between adjacent wraps of the seal material.

15. The tubular string of claim 9, wherein the seal material is positioned in a recess formed on an outer surface of the body portion.

16. The tubular string of claim 9, wherein an extrusion blocking member is positioned for radially outward displacement in response to swelling of the seal material.

17. The tubular string of claim 9, wherein an anchoring member is positioned for radially outward displacement in response to swelling of the seal material.

18. A method of constructing a swellable packer on a tubular string, the method comprising the steps of:

inserting the tubular string into a wellbore; and attaching a swellable seal material to the tubular string to thereby form the packer, the attaching step being performed during the inserting step.

19. The method of claim 18, wherein the attaching step is performed after commencing the inserting step and prior to finishing the inserting step.

20. The method of claim 18, further comprising the step of providing the tubular string as a continuous tubular string.

21. The method of claim 18, further comprising the step of providing the tubular string as a segmented tubular string.

22. The method of claim 18, wherein the attaching step further comprises applying the swellable seal material to the tubular string, and then curing the swellable seal material.

23. The method of claim 18, further comprising the step of applying the swellable seal material to a mandrel, then curing the swellable seal material, and then cutting the swellable seal material off of the mandrel.

24. The method of claim 18, wherein the attaching step further comprises wrapping the swellable seal material about the tubular string.

25. The method of claim 24, wherein the wrapping step further comprises wrapping the swellable seal material at least one of: a) helically about the tubular string, and b) split longitudinally and placed about the tubular string.

26. The method of claim 24, wherein the wrapping step further comprises tightening the swellable seal material about the tubular string.

27. The method of claim 26, wherein the tightening step further comprises securing one end of the swellable seal material to the tubular string while continuing to rotate an opposite end of the swellable material about the tubular string.

28. The method of claim 26, wherein the tightening step further comprises decreasing at least one of: a) gaps formed between adjacent wraps, and b) a gap in a longitudinal split of the swellable seal material.

29. The method of claim 18, further comprising the step of swelling the seal material in response to contact with a fluid, the swelling step including sealing gaps formed between adjacent wraps of the seal material.

30. The method of claim 18, wherein the attaching step further comprises forming a recess on an outer surface of the tubular string, and positioning the swellable seal material in the recess.

31. The method of claim 18, further comprising the step of swelling the seal material in response to contact with a fluid, and displacing an extrusion blocking member radially outward in response to swelling of the seal material.

32. The method of claim 18, further comprising the step of swelling the seal material in response to contact with a fluid, and displacing an anchoring member radially outward in response to swelling of the seal material.

33. The method of claim 18, further comprising the step of applying an adhesive between the swellable seal material and the tubular string.

* * * * *